US010226072B2

(12) United States Patent
Nelson et al.

(10) Patent No.: US 10,226,072 B2
(45) Date of Patent: Mar. 12, 2019

(54) COMBINATION LIGHTER AND CIGAR SPLITTER

(71) Applicant: Great Quality, Inc., Atlanta, GA (US)

(72) Inventors: Macario Nelson, Atlanta, GA (US); Jordan Campbell, Fayetteville, GA (US)

(73) Assignee: GREAT QUALITY INC, Atlanta, GA (US)

( * ) Notice: Subject to any disclaimer, the term of this patent is extended or adjusted under 35 U.S.C. 154(b) by 109 days.

(21) Appl. No.: 15/202,643

(22) Filed: Jul. 6, 2016

(65) Prior Publication Data

US 2018/0007955 A1 Jan. 11, 2018

(51) Int. Cl.
*A24F 13/26* (2006.01)

(52) U.S. Cl.
CPC ..... *A24F 13/26* (2013.01)

(58) Field of Classification Search
CPC ..... A24F 13/24; A24F 13/26
USPC ..... 131/249; 30/109
See application file for complete search history.

(56) References Cited

U.S. PATENT DOCUMENTS 2,141,002 A * 12/1938 Huff ..... H02G 1/1231 30/90.7
2,385,368 A * 9/1945 Montgomery ..... H01B 7/36 30/90.7
3,091,031 A * 5/1963 Grant ..... H02G 1/1231 30/90.7
3,470,781 A * 10/1969 Domeny ..... B65H 35/002 225/23
3,665,063 A * 5/1972 Rupert ..... B29C 49/04 264/529
4,309,822 A * 1/1982 Chirichigno ..... H02G 1/1217 30/90.9
4,366,619 A * 1/1983 Bieganski ..... H02G 1/1224 30/113
4,536,957 A * 8/1985 Britton ..... H02G 1/1217 30/90.4
4,744,146 A * 5/1988 Schmidt ..... B26B 5/001 30/125
4,837,931 A * 6/1989 Beermann ..... A24F 13/24 30/112
4,897,033 A * 1/1990 Yang ..... A24F 13/20 131/233
5,345,952 A * 9/1994 Nielander ..... A24F 13/20 131/235.1
5,738,117 A * 4/1998 Fontaine, Jr. ..... A24F 13/26 131/249
5,890,290 A * 4/1999 Davis ..... B26B 5/003 30/162
6,151,781 A * 11/2000 Dehler ..... A24F 13/26 131/248

(Continued)

*Primary Examiner* — Kenneth E Peterson
(74) *Attorney, Agent, or Firm* — Clayton, McKay & Bailey, PC

(57) ABSTRACT

A combination lighter and cigar-splitter device can include an aperture extending through a portion of the lighter body. A cutting blade can be positioned within the aperture, or proximate to the aperture in the case of an adjustable cutting blade. For example, the cutting blade can be retractable such that when the cutting blade is fully retracted, no portion of the cutting blade is exposed within the aperture. The cutting blade can also be adjustable to one of a plurality of positions to accommodate different diameter cigars.

12 Claims, 4 Drawing Sheets

(56) References Cited

U.S. PATENT DOCUMENTS 6,527,545 B2 * 3/2003 Cook ..... A24F 13/26 131/249
6,557,730 B1 * 5/2003 Kaye ..... B26B 5/001 222/191
6,875,013 B2 * 4/2005 Smith ..... A24F 13/26 131/248
7,861,727 B1 * 1/2011 Jones ..... A24F 13/26 131/253
8,485,200 B1 * 7/2013 Levinger ..... A24F 13/24 131/248
9,089,167 B2 * 7/2015 Lee ..... A24F 13/24
9,486,012 B2 * 11/2016 Spurling ..... A24F 13/24
2004/0142293 A1 * 7/2004 Smith ..... A24F 13/26 431/253
2004/0181945 A1 * 9/2004 Shiraishi ..... G02B 6/245 30/90.1
2007/0000502 A1 * 1/2007 Chong ..... A24F 13/24 131/249
2007/0078472 A1 * 4/2007 Singh ..... A61B 17/3211 606/167
2007/0261174 A1 * 11/2007 Barker ..... B26B 5/00 7/160
2010/0065074 A1 * 3/2010 Lee ..... A44B 15/00 131/253
2010/0269840 A1 * 10/2010 Chuan ..... A24F 13/24 131/249
2012/0240949 A1 * 9/2012 Spurling, III ..... F23Q 2/32 131/253
2014/0165409 A1 * 6/2014 Scimone ..... B26B 5/003 30/162
2014/0173912 A1 * 6/2014 Scimone ..... B26B 5/003 30/162
2016/0167239 A1 * 6/2016 Gallegos ..... B26B 5/001 30/162
2016/0172828 A1 * 6/2016 Liao ..... H02G 1/1212 30/91.2

* cited by examiner

COMBINATION LIGHTER AND CIGAR SPLITTER

DESCRIPTION OF THE EMBODIMENTS

Field of the Embodiments

The embodiments herein relate generally to a combination lighter and cigar splitter, and, more specifically, to a device having a lighter body with an aperture extending through the body and having a cutting blade positioned within the aperture, such that a cigar can be split by passing it through the aperture.

BACKGROUND

In the world of custom cigars, it has become increasingly popular to remove the thick outer leaf, or "wrapper," of a cigar and repurpose it for rolling a personalized blend. To remove the wrapper of a cigar by hand, a cigar enthusiast must either unroll the wrapper or cut the wrapper to remove it. Because unrolling the wrapper is a painstaking process, most enthusiasts elect to slice down the length of the cigar. With the wrapper sliced open, the enthusiast can remove the filler leaves and make room for their personalized blend.

The term "cigar" is intended to be used broadly throughout this disclosure, and can encompass any tobacco-based item intended to be smoked. This includes, for example, cigars, cigarillos, and cigarettes. As used herein, the term "cigar" can encompass any smoking product with an outer leaf, wrapper, or cover that can be removed and reused as part of a custom cigar.

Traditional methods for splitting a cigar can be inaccurate and downright dangerous. One example is using a razor blade or box cutter to split the cigar. These methods produce inconsistent cuts, occasionally ruin a cigar wrapper by cutting too deep (thereby cutting the wrapper twice), and most importantly, risk injury to the cigar enthusiast.

Solutions to the traditional methods have proved unsatisfactory. For example, some solutions require a standalone device for splitting cigars. While these devices adequately split a cigar, they require a cigar enthusiast to purchase, store, and potentially carry around an additional device that only has one purpose. This adds cost as well as complexity, by introducing a device that is inconvenient to store or carry.

As a result, a need exists for a device that accurately and safely splits cigars without forcing a cigar enthusiast to purchase and carry a standalone device. Because a cigar enthusiast must use a lighter to light their cigar, combination lighter and cigar splitter would satisfy the enthusiast's need for purchasing and utilizing fewer devices in the process of rolling custom cigars.

SUMMARY

Embodiments described herein include combination lighter and cigar-splitter devices. In one embodiment, a combination lighter and cigar-splitter device includes a lighter body. As used herein, the term "lighter body" encompasses the elements of a traditional lighter. For example, a lighter body can include a piece of flint, a spark wheel for producing sparks when engaged with the flint, a flint spring for biasing the flint against the spark wheel, a valve for limiting the flow of lighter fluid, a jet for directing the lighter fluid toward the flame, a lever for actuating the jet and/or valve, a lever spring for biasing the lever toward an "off" position, and one or more chambers for storing lighter fluid. Other components can be included within the meaning of "lighter body" as well.

Continuing with the example embodiment above, a combination lighter and cigar-splitter device can include an aperture extending through a portion of the lighter body. For example, the aperture can be molded into the lighter housing that contains lighter fluid. In some examples, at least a portion of the non-exposed surface of the aperture can form an interior wall of one or more chambers for storing lighter fluid within the lighter body. The aperture can be sized to accommodate different size cigars. In some examples, the aperture has a diameter of at least 0.30 inches.

A cutting blade can be positioned within the aperture, or adjacent or proximate to the aperture in the case of an adjustable cutting blade. For example, the cutting blade can be retractable such that when the cutting blade is fully retracted, no portion of the cutting blade is exposed within the aperture. The cutting blade can also be adjustable to one of a plurality of positions to accommodate different diameter cigars. In some examples the cutting blade can be adjustable via a slide coupled to a notched linear track. In another example, the cutting blade can be adjustable via a button that, when pressed, causes the cutting blade to become exposed within the aperture. In some examples, the cutting blade can be oriented such that it aligns with a longitudinal axis of the aperture, such that the cutting blade slices down the length of a cigar as the cigar is passed through the aperture.

In another example, the combination lighter and cigar-splitter device can include a hatch that is shaped to cover at least a portion of the aperture. The hatch can be movable such that the cutting blade can be accessed when desired. For example, the hatch can be hinged such that it can rotate from a first position that covers at least a portion of the aperture, to a second position that exposes the aperture.

In one example, a method is provided for making a combination lighter and cigar splitter. The method can include, for example, providing a lighter body, wherein the lighter body comprises an aperture extending through a portion of the lighter body. The method can also include inserting a cutting blade at least partially within the lighter body, such that the cutting edge of the blade is aligned such that it can at least partially slice a cigar that is passed through the aperture.

In another example, a method is provided for using a combination lighter and cigar splitter. The method can include, for example, providing a lighter body, wherein the lighter body comprises an aperture extending through a portion of the lighter body, and wherein the aperture comprises a cutting blade. The method can also include passing a cigar through the aperture of the lighter body such that the cutting blade slices a portion of the cigar.

Both the foregoing general description and the following detailed description are exemplary and explanatory only and are not intended to restrict the scope of the invention as claimed.

BRIEF DESCRIPTION OF THE DRAWINGS

The accompanying drawings, which are incorporated in and constitute a part of this disclosure, illustrate various embodiments and aspects of the present invention. In the drawings.

DETAILED DESCRIPTION

Reference will now be made in detail to the present exemplary embodiments, including examples illustrated in the accompanying drawings. Wherever possible, the same reference numbers will be used throughout the drawings to refer to the same or like parts.

Figure 1:
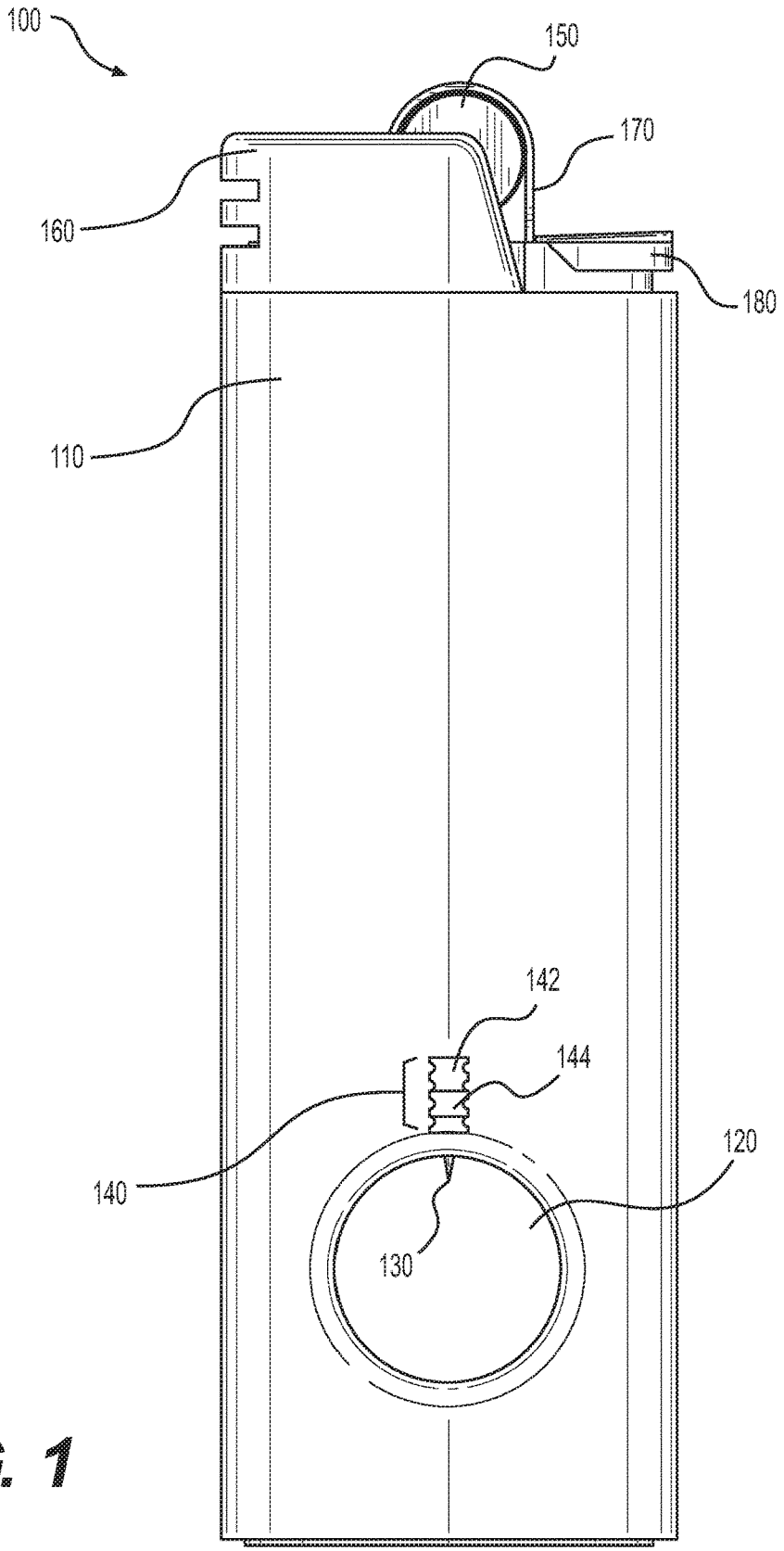
FIG. 1 is an illustration of an example embodiment of a combination lighter and cigar splitter having a slide for adjusting the cutting blade position.

FIG. 1 provides an illustration of an example combination lighter and cigar-splitter device 100. The device 100 of FIG. 1 includes a housing 110 for containing lighter fluid and lighter components, among other things. The housing 110 can be made from a plastic, such as polyethylene, polypropylene, and polystyrene. Alternatively, the housing 110 can be made with any other type of material that can safely store lighter fluid such as butane. In order to accommodate the various components of the combination lighter and cigar-splitter device 100, the housing 110 can be made from a material suitable for injection molding or 3D printing. The housing 110 can be considered as at least a portion of the overall lighter body.

Also part of the lighter body are various lighter components depicted in FIG. 1. For example, FIG. 1 shows a spark wheel 150 used for producing sparks as a result of friction between the spark wheel 150 and a flint component (shown in FIG. 3). The spark wheel 150 can be made from metal, such as a hardened steel, with serrated edges for creating sufficient sparks to light a flame. A hood 160 surrounds a portion of the area where a flame is intended to be located. The hood 160, which can be made from a heat-resistant material such as steel, provides heat protection to the user and wind protection to the flame. A safety guard 170 can be provided over the spark wheel 150, positioned such that the safety guard 170 must be depressed in order to access the spark wheel 150. This feature provides a child-resistant safety feature for the device 100. FIG. 1 also shows a lever 180 for controlling the opening and closing of lighter fluid exiting the housing 110. Additional components are described in conjunction with FIG. 3.

FIG. 1 shows an aperture 120 extending through the housing 110 of the device 100. Although depicted as a circle, the aperture 120 can take any form that accommodates the size and shape of a cigar. For example, the aperture 120 can be a circle, oval, triangle, pentagon, hexagon, or any other cross-sectional shape, so long as a cigar can be passed through the aperture 120. Cigar diameters vary between about 0.3-1.0 inch. As a result, the aperture 120 can be sized such that it accommodates a cigar within these ranges. Because cigar enthusiasts typically choose thinner-diameter cigars for repurposing with a custom blend, in some examples the aperture 120 can be sized on the smaller end of the range, such that it can accommodate cigars having a diameter between about 0.3-0.6 inches.

The example embodiment of FIG. 1 also includes a cutting blade 130. In some examples, the cutting blade 130 is mounted in a fixed position, such that at least a portion of the cutting blade 130 is positioned within the aperture 120. In that scenario, the depth of cut provided by the cutting blade 130 is determined by the diameter of the aperture 120 relative to the cigar being cut, the length of the cutting blade 130, and the user's technique in passing the cigar through the aperture 120. For example, in scenarios where the diameter of the aperture 120 is substantially larger than the diameter of the cigar to be split, then the user can place the cigar in different locations within the aperture 120 to cause different depths of cutting.

An adjustable cutting blade 130, such as the one shown in FIG. 1, can be provided to increase the accuracy of splitting a cigar. For example, FIG. 1 shows a slide mechanism 140 for controlling the placement of the cutting blade 130 within the aperture 120. The slide 140 can be mechanically coupled to the cutting blade 130 such that moving a portion of the slide 140 causes the cutting blade 130 to move accordingly.

In the example of FIG. 1, the slide mechanism 140 includes a track 142 and a slider 144 within the track 142. In this example, the track 142 is linear and includes notches for biasing the position of the slider 144. The slider 144 can be spring biased in a direction away from the housing 110. Further, the slider 144 can be shaped such that it can move linearly along the track 142 when a user presses the slider 144 toward the housing 110 (against the force of the spring). The shape of the slider 144 can also allow the slider 144 to engage the notches of the track 142 when it is not being depressed by a user such that the cutting blade 130 can maintain its position during use. The track 142 can have a plurality of notches for maintaining the slider 144 (and the cutting blade 130) in a corresponding number of positions. Each position within the track 142 corresponds to a different cutting blade 130 position. In some examples, one or more slider 144 positions within the track 142 correspond to one or more cutting blade 130 positions wherein the cutting blade 130 is not exposed within the aperture 120. This allows a user to fully retract the cutting blade 130 such that it does not cause accidental injury when the device 100 is not actively being used to split a cigar.

Additionally, the slide mechanism 140 can be utilized to adjust the position of the cutting blade 130 for splitting different size cigars. For example, a large-diameter cigar may fill the aperture 120 almost completely, and therefore only require a shallow-depth cutting blade 130 to split the outer wrapper of the cigar. In that example, the slide 144 can be positioned within the track 142 such that the cutting blade 130 extends only the desired amount into the aperture 120. A smaller-diameter cigar, on the other hand, can require a longer cutting blade 130 to ensure that the wrapper of the cigar is fully split. In that example, the slide 144 can be positioned within the track 142 such that the cutting blade 130 extends further into the aperture 120. As a result, a smaller cigar can be passed through the aperture 120 while ensuring that the wrapper of the cigar is cut to a sufficient depth.

The slide mechanism 140 shown in FIG. 1 uses linear actuation. That is, the track 142 and notches within the track 142 are arranged in a linear orientation, such that the slide 144 moves linearly within the track 142. In the example of FIG. 1, the slide mechanism 140 is centered above the aperture 120 on a side of the device corresponding with the cross-section of the aperture 120. However, the slide mechanism 140 can be located anywhere on the device 100. For example, the slide mechanism 140 can be located on a portion of the device 100 that is below the aperture 120. In another example, the slide mechanism 140 can be located near the lever 180 for easy access by a user's thumb.

Figure 2:
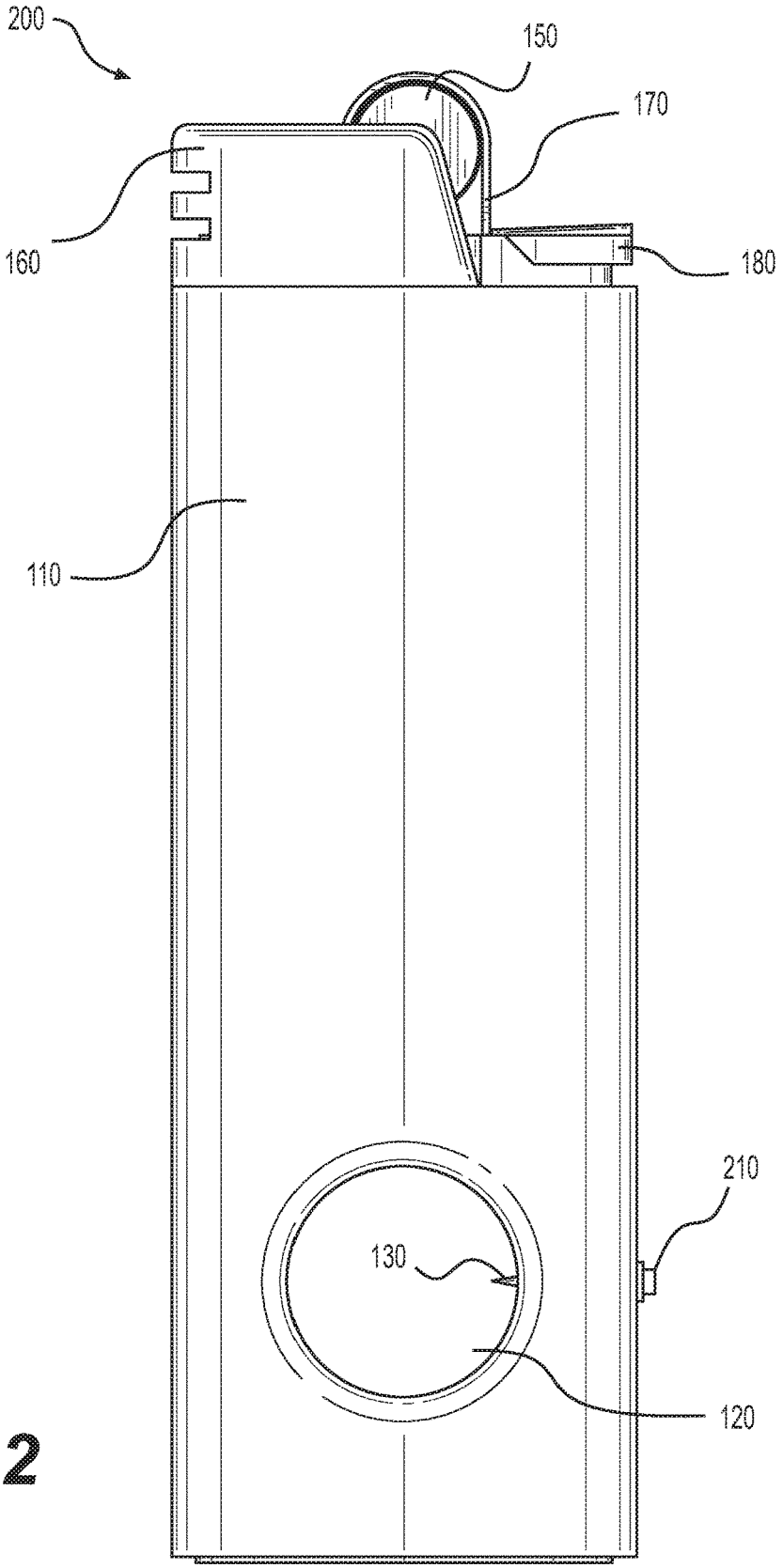
FIG. 2 is an illustration of an example embodiment of a combination lighter and cigar splitter having a button for adjusting the cutting blade position.

FIG. 2 provides an illustration of an alternative example of a combination lighter and cigar-splitter device 200. The device 200 of FIG. 2 includes a housing 110 for containing lighter fluid and lighter components, similar to the housing 110 depicted in FIG. 1. The housing 110 can be considered as at least a portion of the overall lighter body. Also part of the lighter body are various lighter components depicted in FIG. 2. For example, the device 220 includes a spark wheel 150 for producing sparks as a result of friction between the spark wheel 150 and a flint component, a hood 160 surrounding a portion of the area where a flame is intended to be located, a safety guard 170 provided over the spark wheel 150 that must be depressed in order to access the spark wheel 150, and a lever 180 for controlling the opening and closing of lighter fluid exiting the lighter body.

FIG. 2 shows an aperture 120 extending through the housing 110 of the device 200. Although depicted as a circle, the aperture 120 can take any form that accommodates the size and shape of a cigar. For example, the aperture 120 can be a circle, oval, triangle, pentagon, hexagon, or any other cross-sectional shape, so long as a cigar can be passed through the aperture 120. Cigar diameters vary between about 0.3-1.0 inch. As a result, the aperture 120 can be sized such that it accommodates a cigar within these ranges. Because cigar enthusiasts typically choose thinner-diameter cigars for repurposing with a custom blend, in some examples the aperture 120 can be sized on the smaller end of the range, such that it can accommodate cigars having a diameter between about 0.3-0.6 inches.

The example embodiment of FIG. 2 also includes an adjustable cutting blade 130. In this example, the cutting blade 130 can be adjusted via a button 210 mounted on the housing 110 of the device 200. The adjustment can be provided in a variety of different ways. In one example, the button 210 includes an initial position and a depressed position. When the button 210 is in the initial position, the cutting blade 130 is retracted into the housing 110 of the device 200. When the button 210 is in the depressed position, the cutting blade 130 is extended into the aperture 120 of the device 200. This way, a user can retract the cutting blade 130 when it is not needed, preventing unwanted injury.

In another example, the button 210 provides several positions for the cutting blade 130. An initial position can include the cutting blade 130 being fully retracted into the housing 110. A second position, accessed by pressing the button 210 once, can position the cutting blade 130 at least partially within the aperture 120 of the housing 110. A third position, accessed by pressing the button 220 for a second time, can position the cutting blade 130 such that it extends further into the aperture 120 (relative to the second position). Any number of additional positions can be added for extending the cutting blade 130 further into the aperture 120 to accommodate different cigar sizes.

In yet another example, the button 210 can be used without any latching mechanism, to extend the cutting blade 130 without locking it into place. For example, the cutting blade 130 can start in a retracted position, such that it is retracted when a user is not actuating the button 210. Pressing the button 210 can cause the cutting blade 130 to extend into the aperture 120 in proportion to the amount that the button 210 is pressed. In other words, the cutting blade 130 can extend while the button 210 is being pressed, but retract as soon as the button is released. This functionality can help prevent the cutting blade 130 from being extended when the device 200 is not in use, preventing accidental injury.

Figure 3:
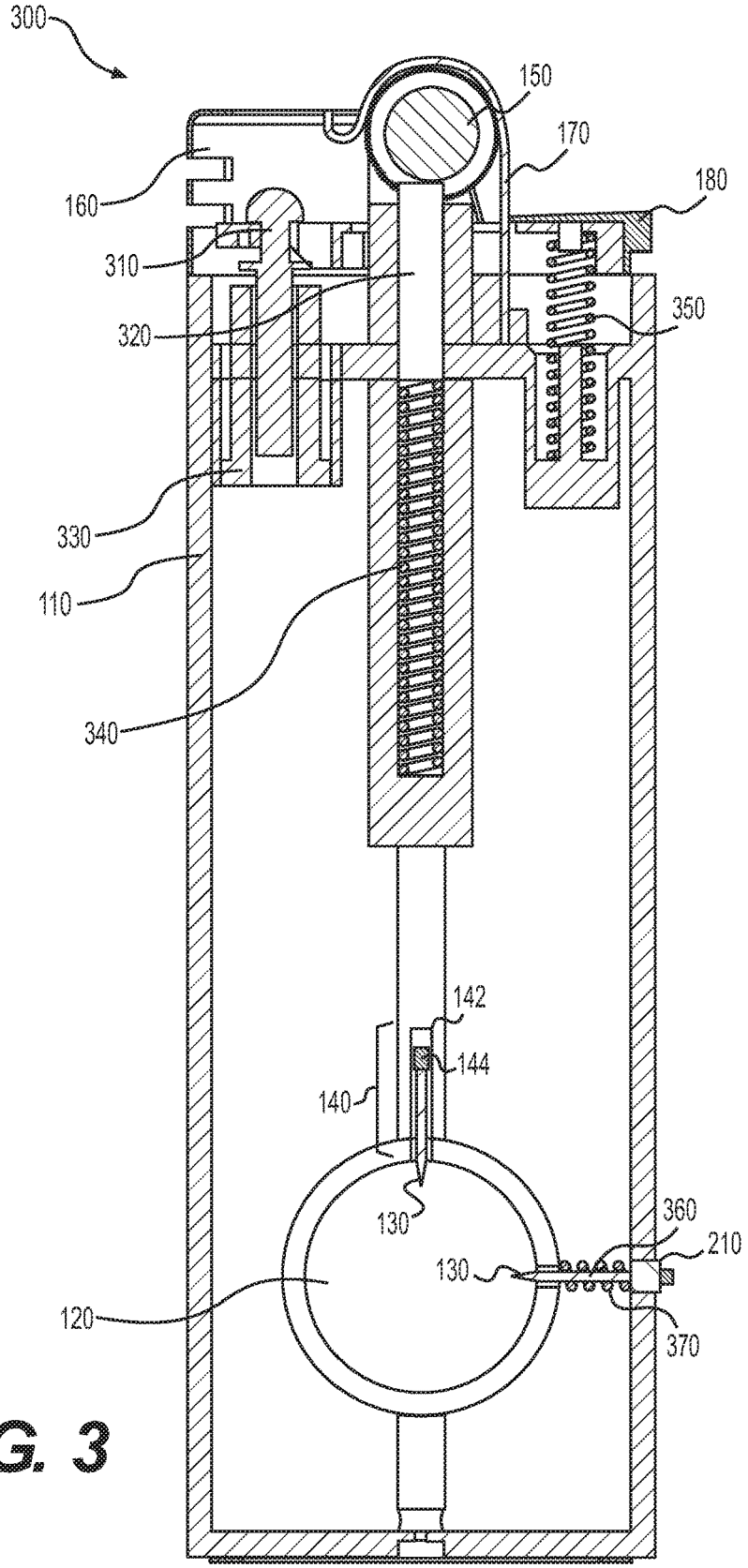
FIG. 3 is a cross-sectional illustration of an example embodiment of a combination lighter and cigar splitter having both a slide and a button for adjusting cutting blades.

FIG. 3 provides a cross-sectional view of an example combination lighter and cigar-splitter device 300. The device 300 of FIG. 3 shows additional components of the device 300, including both cutting blade 130 embodiments from FIGS. 1 and 2. In practice, the device 300 would not have both cutting blade 130 assemblies, but they are both shown together here for convenience.

FIG. 3 shows a cross-sectional view of several lighter components from FIGS. 1 and 2, such as a spark wheel 150, hood 160, safety guard 170, and lever 180. FIG. 3 also depicts a jet 310 used to release lighter fluid, such as butane gas, in a manner that produces a prolonged flame. The lighter fluid can be ignited by the sparks created due to friction between the spark wheel 150 and the flint component 320. The flint component 320 is biased toward the spark wheel 150 via a flint spring 340. The flint spring 340 can be set into a compartment of the housing 110 such that it imparts a force to the flint component 320, causing the flint component 320 to press against the spark wheel 150. Due to the interaction between the flint component 320 and the spark wheel 150, a user can produce sparks by simply turning the spark wheel 150. Of course, if there is a safety guard 170, the user will need to depress the safety guard 170 to rotation the spark wheel 150.

The lever spring 350 is another biasing spring that causes the lever 180 to return to a closed position when not in use. When the lever 180 is pressed down, the lever spring 350 is compressed and the jet 310 is lifted, allowing lighter fluid to flow out of the housing 110. The rate at which the lighter fluid flows can be controlled by the lever 180, the jet 310, and the valve 330. The valve 330 is positioned such that it limits the maximum fluid flow available through the jet. When the lever 180 is released, the lever spring 350 pushes it to a closed position, thereby closing the jet 310 as well.

FIG. 3 shows a cross section of the slide component 140 from FIG. 1. As shown in FIG. 3, the track 142 can be set into a portion of the housing 110, such as via an injection molding process, press fitting, or a combination of both. As shown in FIG. 3, the slider 144 controls the position of the associated cutting blade 130, such that moving the slider 144 toward the aperture 120 causes the cutting blade 130 to extend further into the aperture 120.

FIG. 3 also shows a cross section of the button 210 and its associated components, including a cutting blade 130. In the example of FIG. 3, the button 210 is operatively coupled to a shaft 360 associated with the cutting blade 130. A button spring 370 can surround at least a portion of the shaft 360, and be operatively coupled to the button 210 via either the shaft 360 or a collar around the shaft or button. The button spring 370 can be positioned to compress when the button 210 is pressed. A latching mechanism can be added for retaining the button spring 370 in place when the button 210 is pressed down fully, and then released upon another press of the button 210.

In alternative embodiments, the aperture 120 can be covered by one or more flaps when the cutting blade 130 is not in use, thereby adding an additional or alternative safety mechanism to the device. For example, the flaps can be hinged covers that fit the shape of the aperture 120 and close both sides of the aperture 120, thereby preventing unwanted contact with the cutting blade 130. When a user wishes to use the cutting blade 130, he or she could rotate the flaps about the hinge to expose the cutting blade 130.

In another example, a safety mechanism can be extended into the aperture 120, blocking access to the cutting blade 130. For example, a hollow cylinder can be positioned around the cutting blade 130. The cylinder can be coupled to a spring that biases the cylinder toward a position that blocks access to the cutting blade 130. To use the cutting blade 130, a user could retract the cylinder by, for example, operating a slide mechanism, button, or lever. The same idea can apply to different shapes of safety mechanism rather than just cylinders. In some examples, the safety mechanism is shaped to match the shape of the exposed portion of the cutting blade 130.

A method for using a combination lighter and cigar-splitter device, such as the devices disclosed in FIGS. 1-3, can include providing a lighter body, wherein the lighter body comprises an aperture extending through a portion of the lighter body, and wherein the aperture comprises a cutting blade; and passing a cigar through the aperture of the lighter body such that the cutting blade slices a portion of the cigar. The method for using the device can also include adjusting the cutting blade to one of a plurality of positions to accommodate the size of the cigar. For example, the method can include moving a slide within a notched linear track. In another example, the method can include depressing a button that cases the cutting blade to extend into the aperture.

A method for making a combination lighter and cigar-splitter device can include providing a lighter body, wherein the lighter body comprises an aperture extending through a portion of the lighter body, and inserting a cutting blade at least partially within the lighter body. The cutting blade can be aligned such that it can at least partially slice a cigar that is passed through the aperture. The cutting blade can be adjustable to one of a plurality of positions to accommodate different size cigars. For example, the cutting blade can be adjustable via a slide coupled to a notched linear track. In another example, the cutting blade can be adjustable via a button, such that the cutting blade extends into the aperture when the button is depressed and retracts when the button is released.

Figure 4:
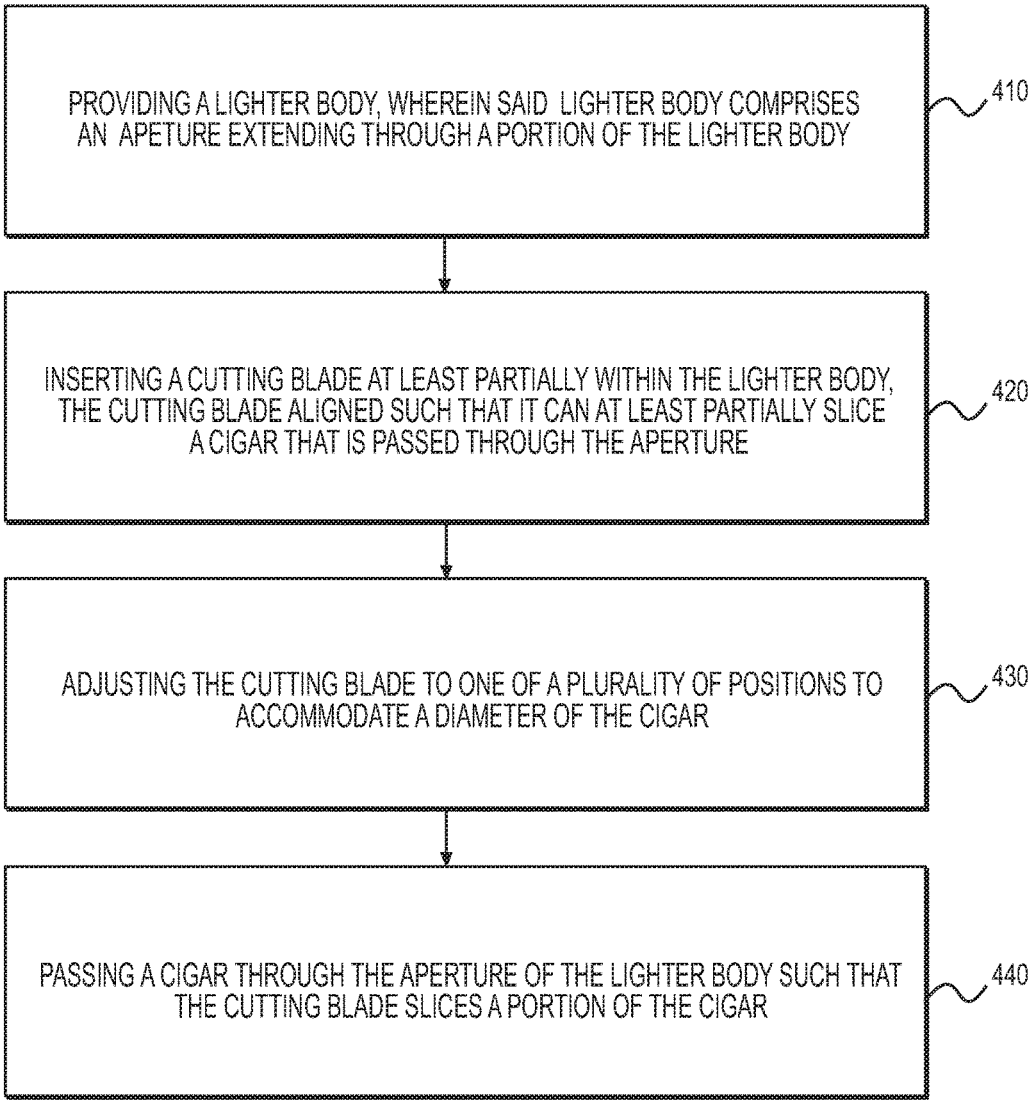
FIG. 4 is a flow chart of an example method for making and using a combination lighter and cigar splitter.

FIG. 4 provides an example flowchart of a method for making and using a combination lighter and cigar splitter. Step 410 includes providing a lighter body, wherein said lighter body comprises an aperture 120 extending through a portion of the lighter body. In some examples, the lighter body includes a housing 110 for containing lighter fluid and lighter components. The lighter body can include, for example, a spark wheel 150, hood 160, safety guard 170, lever 180, jet 310, flint component 320, flint spring 340, valve 330, and lever spring 350. The aperture 120 can be provided such that it passes through the housing 110 portion of the lighter body.

Step 420 includes inserting a cutting blade 130 at least partially within the lighter body. The cutting blade 130 can be aligned such that it can at least partially slice a cigar that is passed through the aperture 120. In some examples, the cutting blade 130 is inserted partially within the lighter body such that a portion of the cutting blade 130 extends into the aperture 120. The cutting blade 130 can be positioned such that when a cigar is passed through the aperture 120, the cutting blade 130 slices the length of the cigar to a thickness sufficient to cut through the outer wrapper of the cigar on one side. In some examples, the cutting blade 130 can slice deeper into the cigar, such as to the centerline of the cigar.

Step 430 includes adjusting the cutting blade 130 to one of a plurality of positions to accommodate a diameter of the cigar. This can be accomplished by, for example, adjusting a slide mechanism 140 including a track 142 and a slider 144 within the track 142. In that example, a user can slide the slider 144 within the track in a direction toward the aperture 120, causing the cutting blade 130 to extend further into the aperture 120. Similarly, the user can slide the slider 144 within the track in a direction away from the aperture 120, causing the cutting blade 130 to extend less into the aperture 120. In another example, adjusting can include depressing a button 210 to adjust the position of the cutting blade 130 to one of several positions. An initial position can include the cutting blade 130 being fully retracted into the housing 110. A second position, accessed by pressing the button 210 once, can position the cutting blade 130 at least partially within the aperture 120 of the housing 110. A third position, accessed by pressing the button 220 for a second time, can position the cutting blade 130 such that it extends further into the aperture 120 (relative to the second position). Any number of additional positions can be added for extending the cutting blade 130 further into the aperture 120 to accommodate different cigar sizes.

Step 440 can include passing a cigar through the aperture 120 of the lighter body such that the cutting blade 130 slices a portion of the cigar. For example, a user may hold the lighter body with one hand and a cigar with the other hand. The user can then insert one tip of the cigar into the aperture 120 of the lighter body and then force the cigar through the aperture 120. Because the cutting blade 130 is positioned to slice the cigar, forcing the cigar through the aperture 120 causes the cutting blade 130 to slice the cigar at the desired thickness. From there, the user is free to remove the inner leaves of the cigar and replace them with a customized blend for optimal enjoyment.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A combination lighter and cigar-splitter device, comprising:

a lighter body;

an aperture extending through a portion of the lighter body, the aperture comprising a longitudinal axis; and a cutting blade mounted within the aperture, the cutting edge of the cutting blade aligned such that it cane at least partially, longitudinally slice a cigar that is passed through the aperture, wherein the aperture is surrounded by a chamber for storing lighter fluid within the lighter body, and wherein the cutting blade is adjustable to one of a plurality of positions to accommodate different diameter cigars via a slide positioned within a notched linear track.

2. The combination lighter and cigar-splitter device of claim 1, wherein the aperture has a diameter of at least 0.30 inches.

3. The combination lighter and cigar-splitter device of claim 1, wherein the cutting blade is retractable into the body of the housing, such that no portion of the cutting blade is exposed within the aperture.

4. The combination lighter and cigar-splitter device of claim 1, wherein a second cutting blade is adjustable via a button, such that the second cutting blade extends into the aperture when the button is depressed and retracts when the button is released.

5. The combination lighter and cigar-splitter device of claim 1, wherein the cutting blade comprises metal.

6. The combination lighter and cigar-splitter device of claim 1, wherein the cutting blade comprises plastic.

7. A method of making a combination lighter and cigar splitter, comprising:

providing a lighter body, wherein said lighter body comprises an aperture extending through a portion of the lighter body, and wherein the aperture is surrounded by a chamber for storing lighter fluid within the lighter body; and inserting a cutting blade at least partially within the lighter body, the cutting blade aligned such that it can at least partially longitudinally slice a cigar that is passed through the aperture, wherein the cutting blade is adjustable to one of a plurality of positions to accommodate different diameter cigars via a slide positioned within a notched linear track.

8. The method of claim 7, wherein the aperture has a diameter of at least 0.30 inches.

9. The method of claim 7, wherein a second cutting blade is adjustable via a button, such that the second cutting blade extends into the aperture when the button is depressed and retracts when the button is released.

10. A method for using a combination lighter and cigar splitter, comprising:

providing a lighter body, wherein said lighter body comprises an aperture extending through a portion of the lighter body, wherein said aperture comprises a cutting blade, wherein the aperture is surrounded by a chamber for storing lighter fluid within the lighter body, and wherein the cutting blade is adjustable to one of a plurality of positions to accommodate different diameter cigars via a slide positioned within a notched linear track; and passing a cigar through the aperture of the lighter body such that the cutting blade longitudinally slices a portion of the cigar.

11. The method of claim 10, wherein the aperture has a diameter of at least 0.30 inches.

12. The method of claim 10, further comprising depressing a button that causes a second cutting blade to extend into the aperture.

* * * * *